US010314442B2

(12) United States Patent
Fields et al.

(10) Patent No.: US 10,314,442 B2
(45) Date of Patent: Jun. 11, 2019

(54) SHOWER CURTAIN ASSEMBLY

(71) Applicants: Audrey Fields, Riverdale, GA (US); Rodney Fields, Riverdale, GA (US)

(72) Inventors: Audrey Fields, Riverdale, GA (US); Rodney Fields, Riverdale, GA (US)

( * ) Notice: Subject to any disclaimer, the term of this patent is extended or adjusted under 35 U.S.C. 154(b) by 0 days.

(21) Appl. No.: 15/625,296

(22) Filed: Jun. 16, 2017

(65) Prior Publication Data

US 2018/0360274 A1 Dec. 20, 2018

(51) Int. Cl.
*A47H 1/102* (2006.01)
*A47K 3/38* (2006.01)
*E06B 9/08* (2006.01)

(52) U.S. Cl.
CPC ..... *A47K 3/38* (2013.01); *A47H 1/102* (2013.01); *E06B 9/08* (2013.01)

(58) Field of Classification Search
CPC ..... A47H 1/00; A47H 1/102; A47H 1/142; E06B 9/08; E06B 9/40; E06B 9/42; A47K 3/38
See application file for complete search history.

(56) References Cited

U.S. PATENT DOCUMENTS 68,189 A * 8/1867 Hanks ..... E06B 9/50 248/267
516,018 A * 3/1894 Lauer ..... B60J 1/205 160/262
951,440 A * 3/1910 Hoxworth ..... A47H 1/13 248/254
1,071,158 A * 8/1913 Hurlbut ..... A47H 19/00 160/108
1,253,486 A * 1/1918 Hammer ..... A47H 1/022 211/105.4
1,334,034 A * 3/1920 Jamison ..... A47H 1/142 160/124
1,480,841 A * 1/1924 Simmons ..... A47H 1/16 248/254
1,621,639 A * 3/1927 Marczukowski ..... E06B 9/50 160/126
1,636,601 A * 7/1927 Givens ..... E06B 9/44 160/108
1,856,752 A * 5/1932 Ellinger ..... A47H 1/13 160/108
1,980,618 A * 11/1934 Gaines ..... A47K 3/38 160/327
1,998,777 A * 4/1935 Dollinger ..... E06B 9/50 160/108

(Continued)

FOREIGN PATENT DOCUMENTS

WO WO199749322 12/1997

*Primary Examiner* — Katherine W Mitchell
*Assistant Examiner* — Johnnie A. Shablack

(57) ABSTRACT

A shower curtain assembly for covering an opening of a shower enclosure includes a housing that defines an internal space. The housing is configured to couple to a substrate so that the housing is positioned proximate to an opening of a shower enclosure. A slot is positioned through a bottom of the housing. The slot extends substantially between opposing ends of the housing. At least one panel, which is flexible so that it can be rolled, is positioned in the internal space. A first end of the at least one panel is positioned through the slot. The slot is positioned to selectively extend the at least one panel from the housing to cover the opening of the shower enclosure.

10 Claims, 4 Drawing Sheets

(56) References Cited

U.S. PATENT DOCUMENTS 2,219,075 A * 10/1940 Le Veau ..... A47H 15/00 16/87.6 R
2,481,397 A * 9/1949 Dalton, Jr. ..... A47K 3/38 160/31
2,756,438 A * 7/1956 Soberman ..... A47K 3/30 15/250.1
2,812,811 A * 11/1957 Collins ..... A47H 1/02 160/38
2,840,827 A * 7/1958 Calvano ..... A47K 3/38 160/11
3,050,742 A * 8/1962 Munson ..... A47K 3/38 160/23.1
3,075,805 A * 1/1963 Golde ..... B60J 7/0015 160/262
3,092,174 A * 6/1963 Winn ..... B60J 1/205 160/262
3,222,689 A * 12/1965 Efron ..... A47K 3/38 4/608
3,606,711 A * 9/1971 Lodato ..... A47G 25/0678 211/105.3
3,965,960 A * 6/1976 Massey ..... A47K 3/38 160/295
4,114,233 A * 9/1978 Hamilton ..... A47H 1/04 16/95 R
4,122,559 A * 10/1978 Kelly ..... A47K 3/38 160/11
4,461,056 A * 7/1984 Solinski ..... A47K 3/38 16/87.4 R
4,754,504 A * 7/1988 Cellini ..... A47K 3/38 16/94 D
4,916,764 A * 4/1990 Meaden ..... A47K 3/38 160/23.1
4,919,350 A * 4/1990 Miller ..... A47K 10/38 225/51
5,033,132 A * 7/1991 Greenblatt ..... A47K 3/38 160/123
5,137,158 A * 8/1992 Brockway ..... B60R 7/02 211/106.01
D334,682 S * 4/1993 Weeks ..... D6/575
5,231,708 A 8/1993 Hansen
5,333,664 A * 8/1994 Sirianni ..... A47K 3/30 160/23.1
5,402,842 A * 4/1995 Ruggiero ..... A47K 3/38 160/330
5,682,627 A * 11/1997 Russell ..... A47K 3/30 160/23.1
5,732,419 A * 3/1998 Feist ..... A47K 3/38 4/557
5,794,281 A * 8/1998 Shearon ..... A47K 3/38 160/29
5,894,610 A * 4/1999 Winter ..... A47K 3/38 285/46
6,216,287 B1 * 4/2001 Wise ..... A47K 3/38 4/610
6,276,002 B1 * 8/2001 Oschmann ..... A47H 23/01 4/558
6,364,568 B2 * 4/2002 Kanbach ..... A47H 1/102 248/200.1
6,595,262 B2 * 7/2003 Chen ..... E06B 9/40 160/23.1
6,655,444 B2 12/2003 Goldenberg et al.
7,328,466 B1 * 2/2008 Bowen ..... A47K 3/302 160/23.1
7,370,839 B2 * 5/2008 Putman ..... A47H 1/102 248/251
7,600,274 B2 10/2009 Washington
8,056,873 B1 * 11/2011 Hanley ..... A47H 1/022 248/261
8,312,910 B2 * 11/2012 Zimmer ..... A47H 1/02 160/110
8,777,302 B2 * 7/2014 Kanai ..... B60J 3/02 160/262
8,826,471 B1 9/2014 Maddox
9,107,529 B2 * 8/2015 Didehvar ..... A47H 1/022
9,271,592 B2 * 3/2016 Didehvar ..... A47H 1/022
9,743,811 B1 * 8/2017 Giumarra ..... A47K 3/38
9,872,580 B1 * 1/2018 Roddy ..... A47H 1/13
9,974,406 B1 * 5/2018 Von Drake ..... A47H 1/142
9,986,865 B2 * 6/2018 Morris ..... A47H 1/142
2004/0031889 A1 * 2/2004 Magnusson ..... A47B 47/027 248/200.1
2004/0099384 A1 * 5/2004 Wu ..... B44D 3/18 160/321
2005/0016697 A1 * 1/2005 Griggs ..... A47H 1/102 160/330
2007/0174956 A1 * 8/2007 Heaslip ..... A47K 3/38 4/558
2007/0215296 A1 9/2007 Voutour
2008/0022451 A1 * 1/2008 Urlich ..... A47K 3/38 4/610
2012/0175330 A1 * 7/2012 Nicholls ..... A47B 97/00 211/90.01
2013/0283519 A1 10/2013 Holden
2016/0326800 A1 * 11/2016 Marocco ..... E06B 9/42
2017/0071390 A1 * 3/2017 Moss ..... A47H 1/142
2018/0038162 A1 * 2/2018 Colson ..... E06B 9/42

* cited by examiner

SHOWER CURTAIN ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to curtain assemblies and more particularly pertains to a new curtain assembly for covering an opening of a shower enclosure.

BRIEF SUMMARY OF THE INVENTION

An embodiment of the disclosure meets the needs presented above by generally comprising a housing that defines an internal space. The housing is configured to couple to a substrate so that the housing is positioned proximate to an opening of a shower enclosure. A slot is positioned through a bottom of the housing. The slot extends substantially between opposing ends of the housing. At least one panel, which is flexible so that it can be rolled, is positioned in the internal space. A first end of the at least one panel is positioned through the slot. The slot is positioned to selectively extend the at least one panel from the housing to cover the opening of the shower enclosure.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
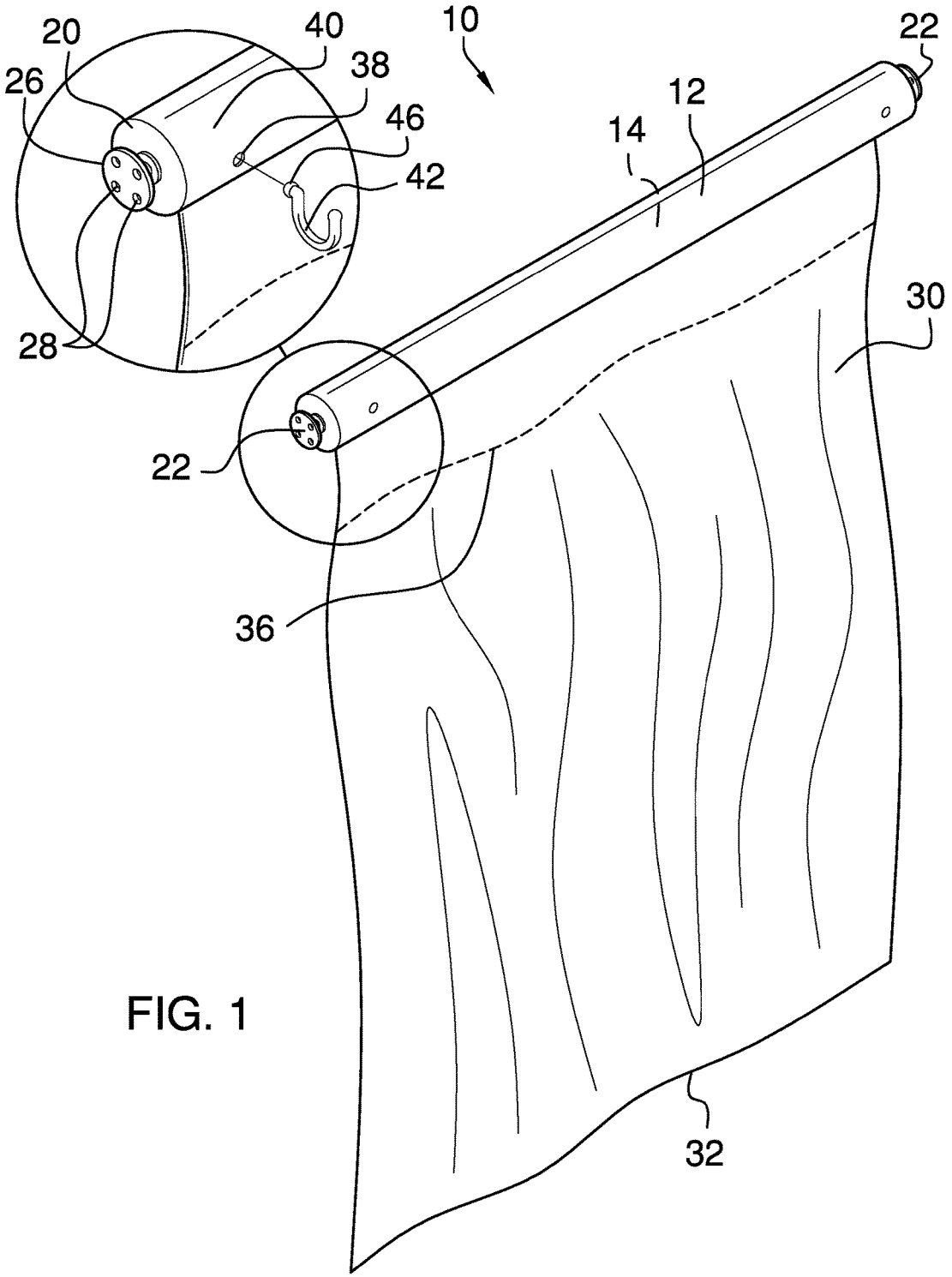
FIG. 1 is an isometric perspective view of a shower curtain assembly according to an embodiment of the disclosure.
Figure 2:
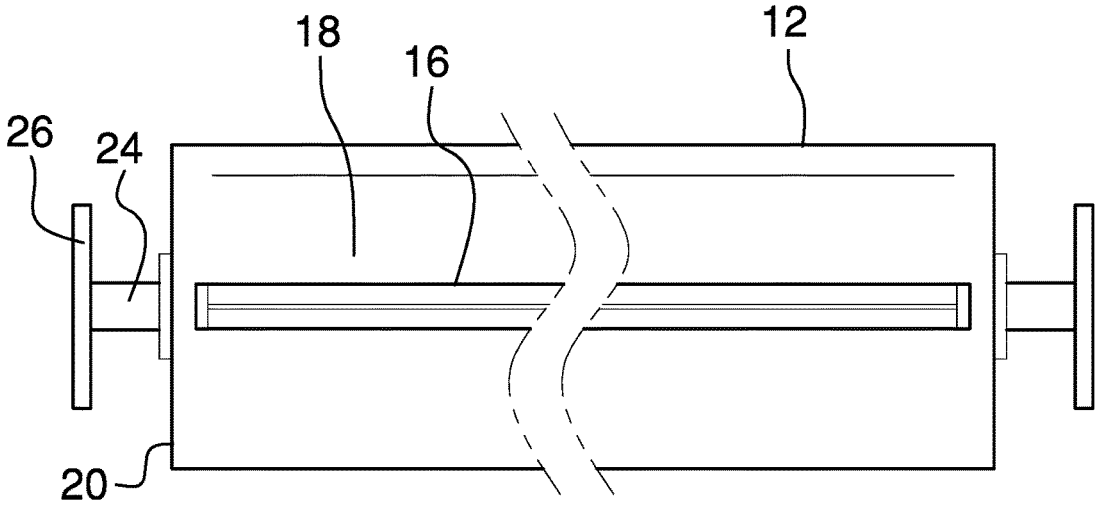
FIG. 2 is a bottom view of an embodiment of the disclosure.
Figure 3:
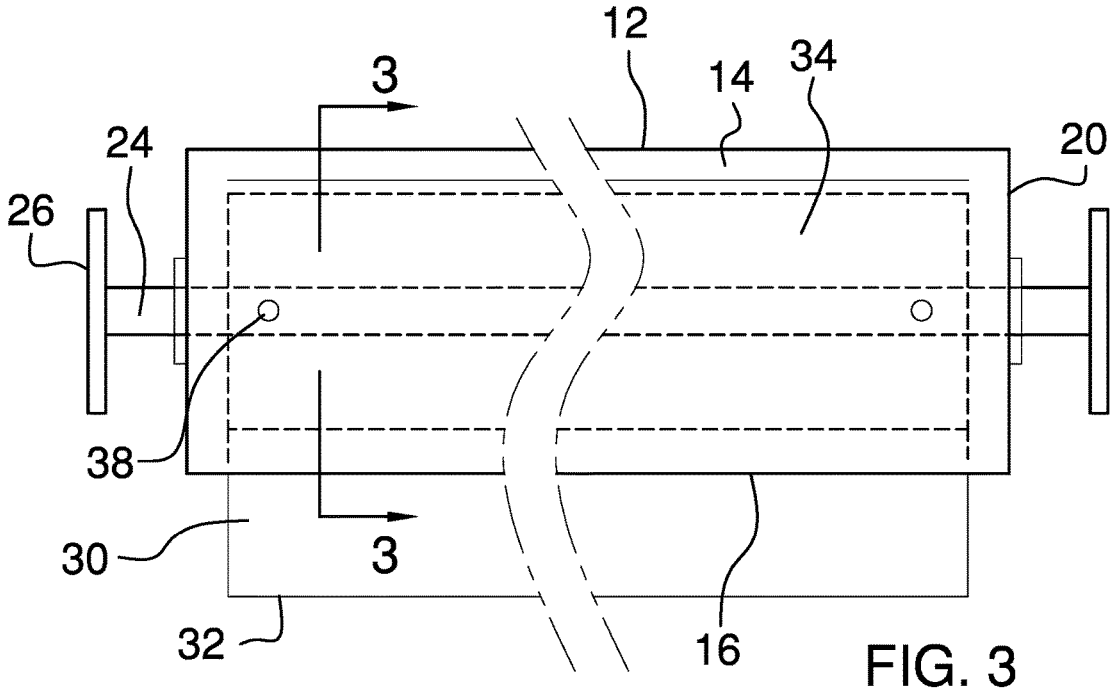
FIG. 3 is a front view of an embodiment of the disclosure.
Figure 4:
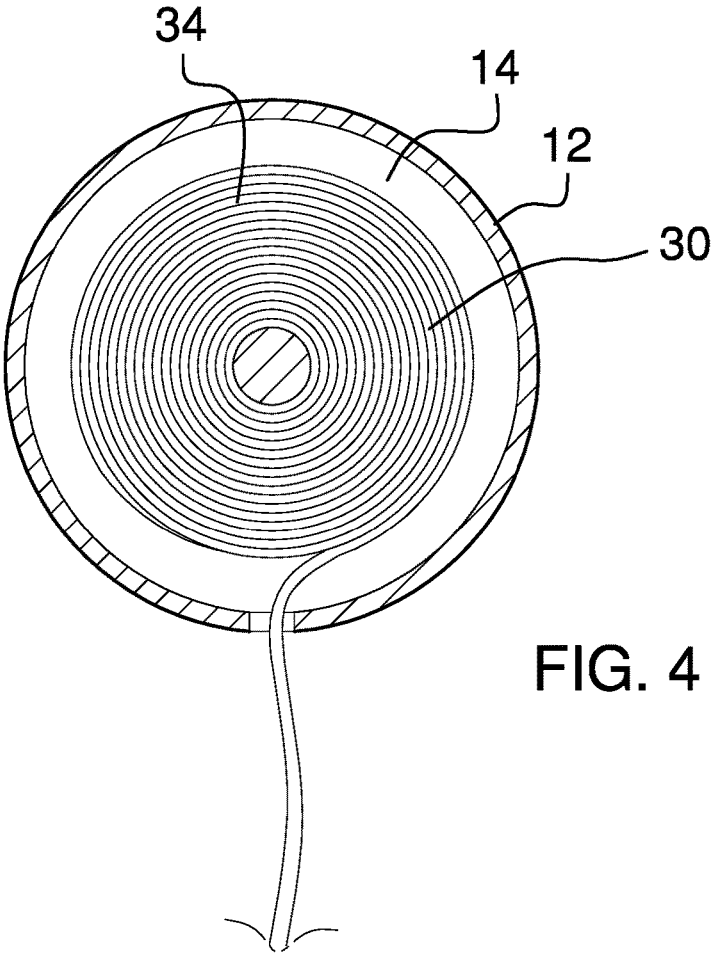
FIG. 4 is a cross-sectional view of an embodiment of the disclosure.
Figure 5:
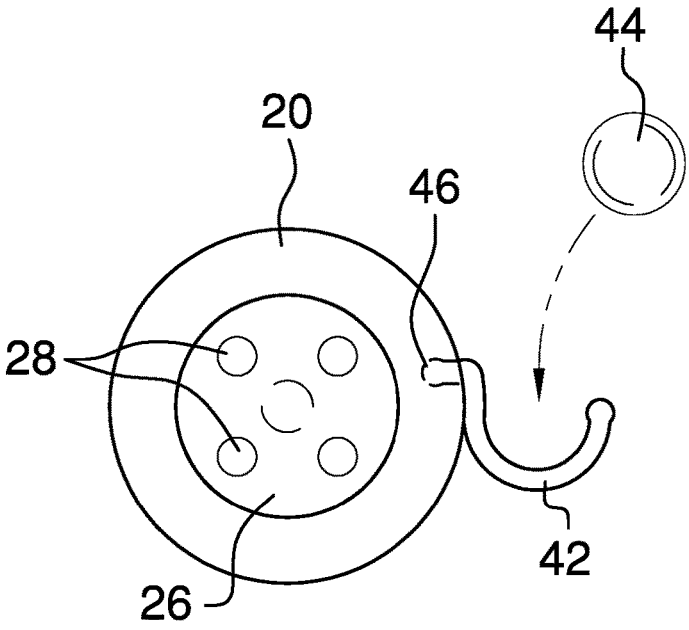
FIG. 5 is a side view of an embodiment of the disclosure.
Figure 6:
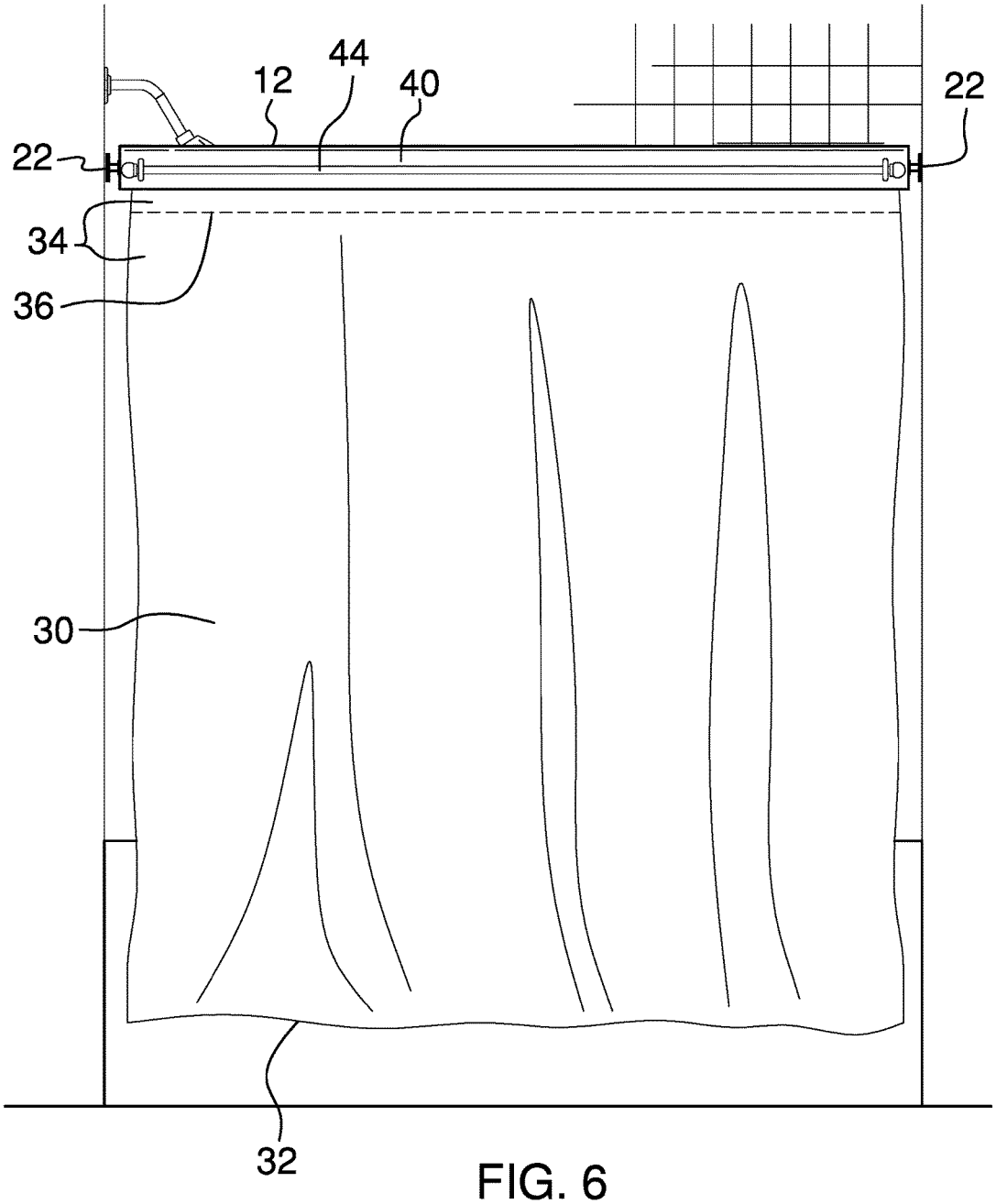
FIG. 6 is an in-use view of an embodiment of the disclosure.

With reference now to the drawings, and in particular to FIGS. 1 through 6 thereof, a new curtain assembly embodying the principles and concepts of an embodiment of the disclosure and generally designated by the reference numeral 10 will be described.

As best illustrated in FIGS. 1 through 6, the shower curtain assembly 10 generally comprises a housing 12 that defines an internal space 14. The housing 12 is configured to couple to a substrate so that the housing 12 is positioned proximate to an opening of a shower enclosure. In one embodiment, the housing 12 is substantially circularly shaped when viewed longitudinally. In another embodiment, the housing 12 is linear so that the housing 12 extends parallelly to the opening of the shower enclosure when the housing 12 is coupled to the substrate. In yet another embodiment, the housing 12 is arcuate so that the housing 12 extends distally from the opening of the shower enclosure when the housing 12 coupled to the substrate.

A slot 16 is positioned through a bottom 18 of the housing 12. The slot 16 extends substantially between opposing ends 20 of the housing 12.

Each of a pair of couplers 22 is coupled to a respective opposing end 20 of the housing 12. The couplers 22 are configured to couple to the substrate to couple the housing 12 to the substrate so that the housing 12 is positioned proximate to the opening of the shower enclosure.

In one embodiment, each coupler 22 comprises a bar 24, a disc 26, and a plurality of penetrations 28. The bar 24 is coupled to and extends linearly from a respective opposing end 20 of the housing 12. The disc 26 is axially coupled to the bar 24 distal from the housing 12. The penetrations 28 are positioned through the disc 26. Each penetration 28 is configured to insert an item of mounting hardware, such as a screw, to couple the disc 26 to the substrate to couple the housing 12 to the substrate. The housing 12 is positioned proximate to the opening of the shower enclosure. In another embodiment, the plurality of penetrations 28 comprises four penetrations 28.

The assembly 10 comprises at least one panel 30. The at least one panel 30 is flexible so that the at least one panel 30 is rollable. The at least one panel 30 is positioned in the internal space 14 with a first end 32 of the at least one panel 30 positioned through the slot 16. The slot 16 is positioned to selectively extend the at least one panel 30 from the housing 12 to cover the opening of the shower enclosure. In one embodiment, the at least one panel 30 is substantially water impermeable.

The at least one panel 30 comprises a plurality of sheets 34. Adjacent sheets 34 are selectively separable along a respective perforation 36 that is positioned in the at least one panel 30. Each sheet 34 is substantially complementary to the opening of the shower enclosure. The slot 16 is positioned to selectively extend a respective sheet 34 from the housing 12 to cover the opening of the shower enclosure. The respective sheet 34 is selectively separable along an associated perforation 36 from the adjacent sheet 34. The adjacent sheet 34 then is positioned to be extended from the housing 12 to sequentially cover the opening of the shower enclosure.

In one embodiment, a plurality of holes 38 is positioned through a front 40 of the housing 12. In this embodiment, the assembly 10 comprises a plurality of hooks 42 and a rod 44. Each hook 42 has a first terminus 46 that is complementary to a respective hole 38. The holes 38 are positioned in the housing 12 so that each hole 38 is positioned to insert the first terminus 46 of a respective hook 42 to couple the hooks 42 to the housing 12. The rod 44 is complementary to the plurality of hooks 42. The hooks 42 are positioned to couple to the rod 44 to couple the rod 44 to the housing 12. The rod 44 is configured to support a covering, such as a decorative curtain, to shield the housing 12. In another embodiment, the plurality of holes 38 comprises two holes 38 that are positioned singly proximate to the opposing ends 20 of the housing 12.

In use, the penetrations 28 are positioned through the disc 26 so that each penetration 28 is configured to insert the item of mounting hardware, such as the screw, to couple the disc 26 to the substrate to couple the housing 12 to the substrate. The housing 12 is positioned proximate to the opening of the shower enclosure. The slot 16 that is positioned in the housing 12 is positioned to selectively extend the respective sheet 34 from the housing 12 to cover the opening of the shower enclosure. The respective sheet 34 is selectively separable along the associated perforation 36 from the adjacent sheet 34. The adjacent sheet 34 then is positioned to be extended from the housing 12 to sequentially cover the opening of the shower enclosure. The hooks 42 that are positioned on the housing 12 are positioned to couple to the rod 44 to couple the rod 44 to the housing 12. The rod 44 is configured to support the covering, such as the decorative curtain, to shield the housing 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A shower curtain assembly comprising:

a housing defining an internal space, said housing being configured for coupling to a substrate such that said housing is positioned proximate to an opening of a shower enclosure;

a slot positioned through a bottom of said housing, said slot extending substantially between opposing ends of said housing;

at least one panel, said at least one panel being flexible such that said at least one panel is rollable, said at least one panel being positioned in said internal space with a first end of said at least one panel positioned through said slot;

a plurality of holes positioned through a front of said housing;

a plurality of hooks, each said hook having a first terminus, said first terminus being complementary to a respective said hole, wherein said holes are positioned in said housing such that each said hole is positioned for inserting said first terminus of a respective said hook for coupling said hooks to said housing;

a rod complementary to said plurality of hooks; and wherein said hooks are positioned in said housing such that said hooks are positioned for coupling to said rod for coupling said rod to said housing such that said rod is configured for supporting a covering for shielding said housing; and wherein said slot is positioned in said housing such that said slot is positioned for selectively extending said at least one panel from said housing for covering the opening of the shower enclosure.

2. The assembly of claim 1, further including said housing being substantially circularly shaped when viewed longitudinally.

3. The assembly of claim 1, further including said housing being linear such that said housing extends parallelly to the opening of the shower enclosure when coupled to the substrate.

4. The assembly of claim 1, further including said at least one panel comprising a plurality of sheets, adjacent said sheets being selectively separable along a respective perforation positioned in said at least one panel, each said sheet being substantially complementary to the opening of the shower enclosure, wherein said slot is positioned in said housing such that said slot is positioned for selectively extending a respective said sheet from said housing for covering the opening of the shower enclosure, wherein said respective said sheet is selectively separable along an associated said perforation from said adjacent said sheet such that said adjacent said sheet is positioned for extending from said housing for sequentially covering the opening of the shower enclosure.

5. The assembly of claim 1, further including said plurality of holes comprising two said holes positioned singly proximate to said opposing ends of said housing.

6. The assembly of claim 1, further including said at least one panel being substantially water impermeable.

7. The assembly of claim 1, further including a pair of couplers, each said coupler being coupled to a respective said opposing end of said housing, said couplers being configured for coupling to the substrate for coupling said housing to the substrate such that said housing is positioned proximate to the opening of the shower enclosure.

8. The assembly of claim 7, further including each said coupler comprising a bar, a disc, and a plurality of penetrations, said bar being coupled to and extending linearly from a respective said opposing end of said housing, said disc being axially coupled to said bar distal from said housing, said penetrations being positioned through said disc, wherein said penetrations are positioned through said disc such that each said penetration is configured for inserting an item of mounting hardware for coupling said disc to the substrate for coupling said housing to the substrate such that said housing is positioned proximate to the opening of the shower enclosure.

9. The assembly of claim 8, further including said plurality of penetrations comprising four said penetrations.

10. A shower curtain assembly comprising:

a housing defining an internal space, said housing being configured for coupling to a substrate such that said housing is positioned proximate to an opening of a shower enclosure, said housing being substantially circularly shaped when viewed longitudinally, said housing being linear such that said housing extends parallelly to the opening of the shower enclosure when coupled to the substrate;

a slot positioned through a bottom of said housing, said slot extending substantially between opposing ends of said housing;

a pair of couplers, each said coupler being coupled to a respective said opposing end of said housing, said couplers being configured for coupling to the substrate for coupling said housing to the substrate such that said housing is positioned proximate to the opening of the shower enclosure, each said coupler comprising a bar, a disc, and a plurality of penetrations, said bar being coupled to and extending linearly from a respective said opposing end of said housing, said disc being axially coupled to said bar distal from said housing, said penetrations being positioned through said disc, wherein said penetrations are positioned through said disc such that each said penetration is configured for inserting an item of mounting hardware for coupling said disc to the substrate for coupling said housing to the substrate such that said housing is positioned proximate to the opening of the shower enclosure, said plurality of penetrations comprising four said penetrations;

at least one panel, said at least one panel being flexible such that said at least one panel is rollable, said at least one panel being positioned in said internal space with a first end of said at least one panel positioned through said slot, wherein said slot is positioned in said housing such that said slot is positioned for selectively extending said at least one panel from said housing for covering the opening of the shower enclosure, said at least one panel being substantially water impermeable, said at least one panel comprising a plurality of sheets, adjacent said sheets being selectively separable along a respective perforation positioned in said at least one panel, each said sheet being substantially complementary to the opening of the shower enclosure, wherein said slot is positioned in said housing such that said slot is positioned for selectively extending a respective said sheet from said housing for covering the opening of the shower enclosure, wherein said respective said sheet is selectively separable along an associated said perforation from said adjacent said sheet such that said adjacent said sheet is positioned for extending from said housing for sequentially covering the opening of the shower enclosure;

a plurality of holes positioned through a front of said housing, said plurality of holes comprising two said holes positioned singly proximate to said opposing ends of said housing;

a plurality of hooks, each said hook having a first terminus, said first terminus being complementary to a respective said hole, wherein said holes are positioned in said housing such that each said hole is positioned for inserting said first terminus of a respective said hook for coupling said hooks to said housing;

a rod complementary to said plurality of hooks, wherein said hooks are positioned in said housing such that said hooks are positioned for coupling to said rod for coupling said rod to said housing such that said rod is configured for supporting a covering for shielding said housing; and wherein said penetrations are positioned through said disc such that each said penetration is configured for inserting the item of mounting hardware, such as the screw, for coupling said disc to the substrate for coupling said housing to the substrate such that said housing is positioned proximate to the opening of the shower enclosure, wherein said slot is positioned in said housing such that said slot is positioned for selectively extending said respective said sheet from said housing for covering the opening of the shower enclosure, wherein said respective said sheet is selectively separable along said associated said perforation from said adjacent said sheet such that said adjacent said sheet is positioned for extending from said housing for sequentially covering the opening of the shower enclosure, wherein said hooks are positioned in said housing such that said hooks are positioned for coupling to said rod for coupling said rod to said housing such that said rod is configured for supporting the covering, such as the decorative curtain, for shielding said housing.

* * * * *